US007480469B2

(12) United States Patent
Gross et al.

(10) Patent No.: US 7,480,469 B2
(45) Date of Patent: Jan. 20, 2009

(54) SYSTEM AND METHOD FOR DETERMINING AN AMOUNT OF TONER MASS ON A PHOTORECEPTOR

(75) Inventors: Eric Michael Gross, Rochester, NY (US); Eric Scott Hamby, Fairport, NY (US); Mark Sennett Jackson, Rochester, NY (US); R. Enrique Viturro, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 242 days.

(21) Appl. No.: 11/581,488

(22) Filed: Oct. 17, 2006

(65) Prior Publication Data

US 2008/0089708 A1 Apr. 17, 2008

(51) Int. Cl.
*G03G 15/00* (2006.01)

(52) U.S. Cl. ..... 399/49

(58) Field of Classification Search ..... 399/49, 399/60, 74

See application file for complete search history.

(56) References Cited

U.S. PATENT DOCUMENTS 5,204,538 A 4/1993 Genovese

2004/0208661 A1* 10/2004 Kitagawa et al. ..... 399/49

* cited by examiner

*Primary Examiner*—Hoang Ngo
(74) *Attorney, Agent, or Firm*—Pillsbury Winthrop Shaw Pittman LLP

(57) ABSTRACT

A system that determines an amount of toner mass present on a toner application surface, and comprises a specular reflection sensor, a diffuse reflection sensor, an output combination module, and a mass determination module. The specular reflection sensor receives electromagnetic radiation that has been specularly reflected by the toner application surface, and generates a specular reflection output representative of the received electromagnetic radiation. The diffuse reflection sensor receives electromagnetic radiation that has been diffusely reflected by the toner application surface, and generates a diffuse reflection output representative of the received electromagnetic radiation. The output combination module creates a combined output by combining the specular reflection output and the diffuse reflection output with the purpose of reducing a noise source common to both specular and diffuse outputs to improve the signal to noise ratio. The mass determination module determines an amount of toner mass present on the toner application surface based on the combined output.

20 Claims, 4 Drawing Sheets

FIG. 2
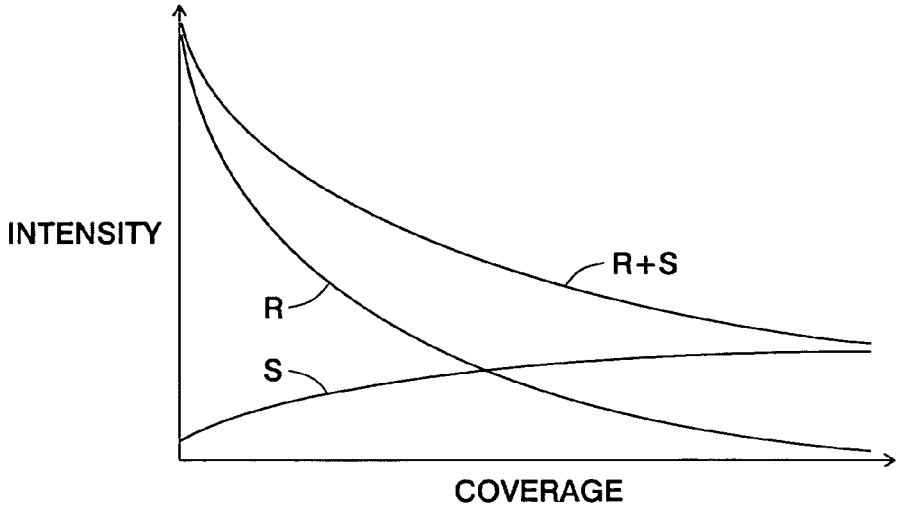
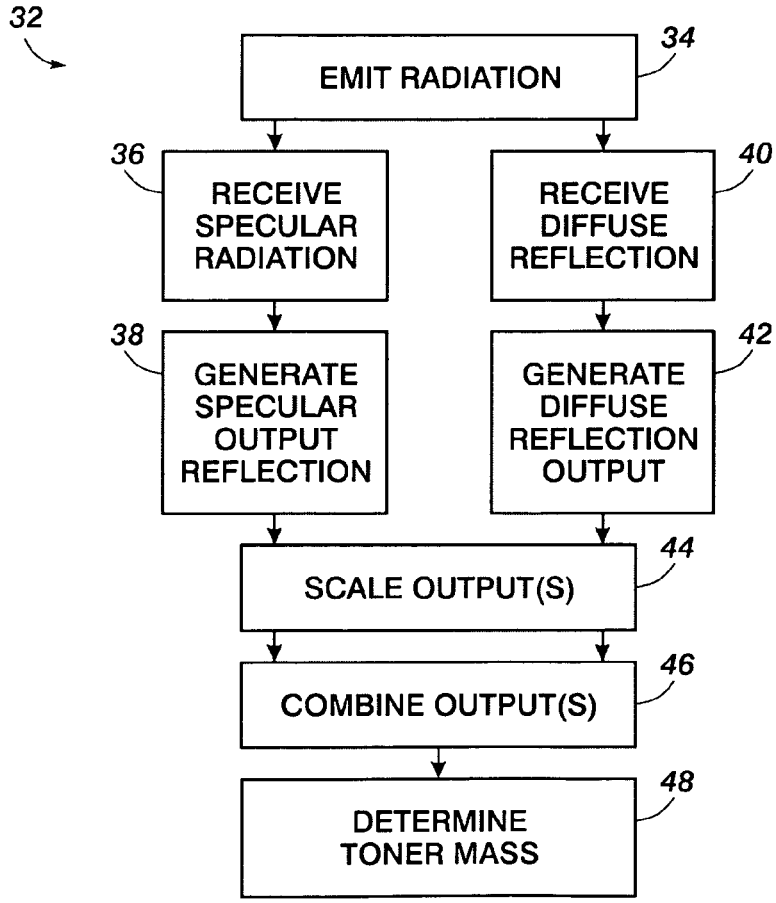
FIG. 3

SYSTEM AND METHOD FOR DETERMINING AN AMOUNT OF TONER MASS ON A PHOTORECEPTOR

FIELD

The disclosure relates to a system and method for determining an amount of toner mass present on a toner application surface, and the calibration of the system.

BACKGROUND

Conventional printing devices exist in which a photoreceptor belt is used to provide toner mass to a base medium (e.g., paper). In order to accurately control the amount of toner mass being delivered to the base medium, these devices tend to include systems that determine the amount of toner mass being carried by the photoreceptor belt. These systems tend to be temperamental and sensitive to changes to the photoreceptor belt, and/or other components of the printing device, that occur due to wear. For example, the surface of the photoreceptor belt may degrade over time such that surfaces on the belt become less reflective, less uniform, etc. This may cause light that is directed to the belt (e.g., for the purpose of measuring the amount of toner mass present, etc.) to be "lost" in the system through absorption, scattering, and/or transmission. The loss of light caused by imperfections in the belt, and/or other components of the printing device may require relatively frequent calibration of the device using a relatively intricate and time consuming process.

These and other drawbacks associated with printing devices and systems that determine the amount of toner mass being delivered to a base medium by a printing device exist.

SUMMARY

One aspect of the disclosure a system that determines an amount of toner mass present on a toner application surface. In one embodiment, the system comprises a specular reflection sensor, a diffuse reflection sensor, an output combination module, and a mass determination module. The specular reflection sensor (i) is arranged to receive electromagnetic radiation that has been specularly reflected by the toner application surface and (ii) is configured to generate a specular reflection output representative of one or more of the properties of the electromagnetic radiation received by the specular reflection sensor. The diffuse reflection sensor (i) is arranged to receive electromagnetic radiation that has been diffusely reflected by the toner application surface and (ii) is configured to generate a diffuse reflection output representative of one or more of the properties of the electromagnetic radiation received by the diffuse reflection sensor. The output combination module creates a combined output by combining the specular reflection output and the diffuse reflection output. The mass determination module determines an amount of toner mass present on the toner application surface based on the combined output.

Another aspect of the invention a method of determining an amount of toner mass present on a toner application surface. In one embodiment, the method comprises receiving electromagnetic radiation that has been specularly reflected by the toner application surface; generating a specular reflection output representative of one or more of the properties of the received electromagnetic radiation that has been specularly reflected by the toner application surface; receiving electromagnetic radiation that has been diffusely reflected by the toner application surface; generating a diffuse reflection output representative of one or more of the properties of the received electromagnetic radiation that has been diffusely reflected by the toner application surface; combining the specular reflection output and the diffuse reflection output to create a combined output; and determining an amount of toner mass present on the toner application surface based on the combined output.

Another aspect of the disclosure relates to a method of calibrating a system configured to determine an amount of toner mass present on a toner application surface. In one embodiment, the method comprises directing electromagnetic radiation the toner application surface while the toner application surface carries a known amount of toner mass such that a portion of the electromagnetic radiation is specularly reflected by the toner application surface and a portion of the electromagnetic radiation is diffusely reflected by the toner application surface, wherein one or more properties of the portion of electromagnetic radiation that is specularly reflected by the toner application surface and the portion of electromagnetic radiation that is diffusely reflected by the toner application surface vary as a function of (i) the amount of toner present on the toner application surface and (ii) noise caused by light loss in the system being calibrated; receiving, with a specular reflection sensor, electromagnetic radiation that has been specularly reflected from the toner application surface; generating, with the specular reflection sensor, a specular reflection output that represents one or more of the properties of the electromagnetic radiation that has been specularly reflected from the toner application surface; receiving, with a diffuse reflection sensor, electromagnetic radiation that has been diffusely reflected from the toner application surface; generating, with the diffuse reflection sensor, a diffuse reflection output that represents one or more of the properties of the electromagnetic radiation that has been diffusely reflected from the toner application surface; and determining, based on the specular reflection output and the diffuse reflection output, at least one scaling factor that can be used to scale outputs generated by one or both of the specular reflection sensor and the diffuse reflection sensor such that when outputs generated by the specular reflection sensor and the diffuse reflection sensor are scaled and then combined to create a combined output, the combined output is substantially free from the noise caused by light loss in the system being calibrated.

BRIEF DESCRIPTION OF THE DRAWINGS

FIG. 2 is a plot illustrating a relationship between reflective properties of a toner application surface and an amount of toner mass present on the toner application surface.

FIG. 3 illustrates a method of determining an amount of toner mass present on a toner application surface.

DETAILED DESCRIPTION

Figure 1:
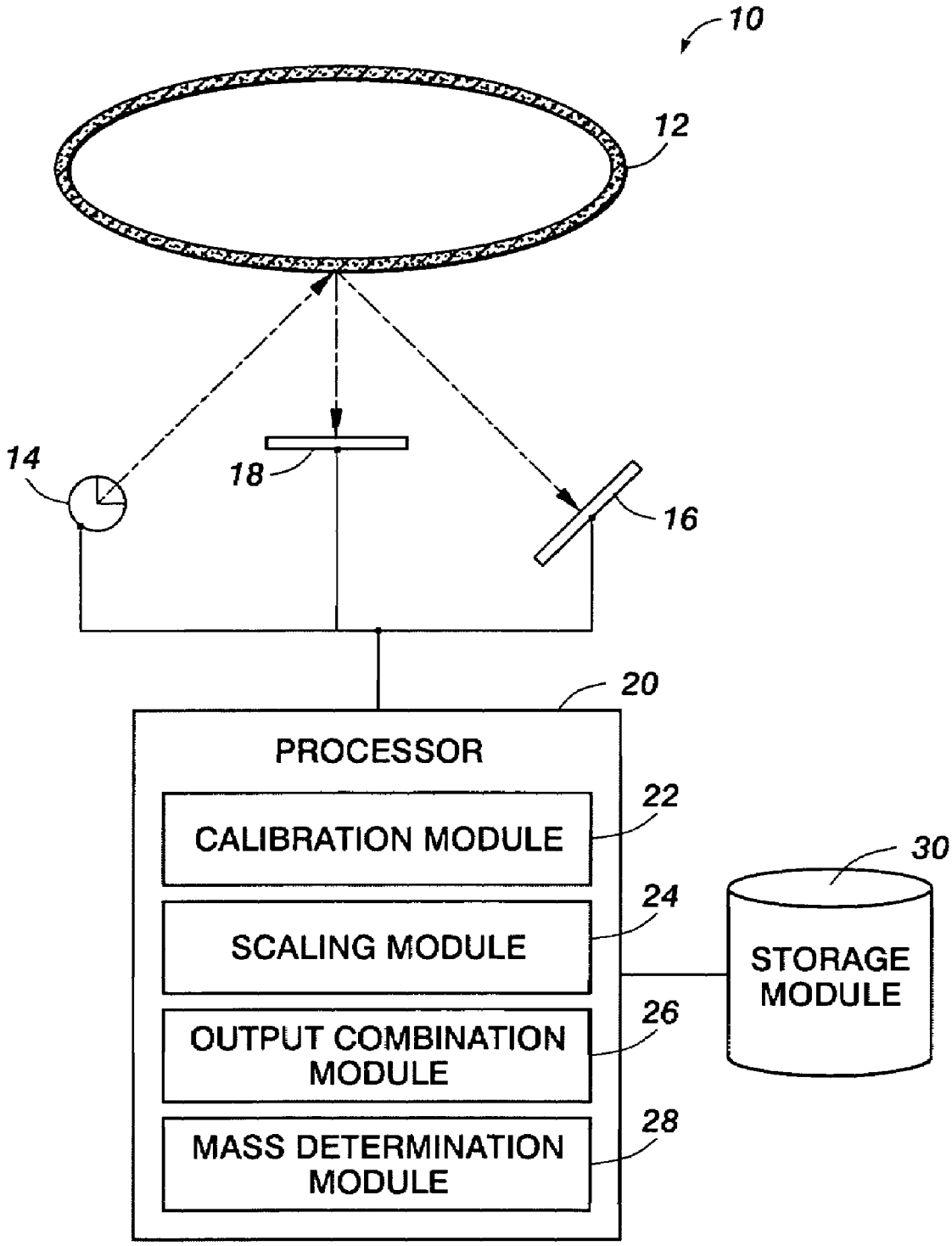
FIG. 1 is an illustration of a system configured to determine an amount of toner mass present on a toner application surface.

FIG. 1 illustrates one or more embodiments of a system 10 configured to determine an amount of toner mass present on a toner application surface 12. In the implementation of system 10 shown in FIG. 1, system 10 includes an emitter 14, a specular reflection sensor 16, a diffuse reflection sensor 18, and a processor 20. In some embodiments, toner application surface 12 may be a surface of a belt, such as a photoreceptor belt, disposed in a printing device. In these embodiments, the belt is adapted to carry toner mass, and apply the carried toner mass to a base medium (e.g., paper, etc.) during printing. In various implementations the components of system 10 may also be disposed within the printing device that includes toner application surface 12. In other implementations, some of the components of system 10 may be external to the printing device. For example, some of the components may be disposed within a client computer operating to control the printing device.

Emitter 14 emits electromagnetic radiation that is directed onto toner application surface 12. In some implementations, emitter 14 may include one or more Organic Light Emitting Diodes ("OLEDs"), lasers (e.g., diode lasers or other laser sources), Hot Cathode Fluorescent Lamps ("HCFLs"), Cold Cathode Fluorescent Lamps ("CCFLs"), incandescent lamps, halogen bulbs, received ambient light, and/or other electromagnetic radiation sources. In one embodiment, emitter 14 includes one or more Light Emitting Diodes ("LEDs"). This embodiment may take advantage of the relatively light weight, compactness, low power consumption, low voltage requirements, low heat production, reliability, ruggedness, low cost, and stability of LEDs. However, it should be appreciated that this embodiment is by no means limiting. In some implementations, system 10 may include one or more optical elements (not shown) to guide, focus, filter, and/or otherwise process radiation emitted by emitter 14. For example, one or more lenses may collimate the radiation in a selected direction.

Specular reflection sensor 16 is arranged to receive electromagnetic radiation that has been emitted by emitter 14 and specularly reflected by toner application surface 12. Specular reflection sensor 16 then generates a specular reflection output that represents one or more properties of the received electromagnetic radiation. In one embodiment, specular reflection sensor 16 includes one or more photosensitive detectors positioned to receive at least a portion of the electromagnetic radiation that is emitted by emitter 14 and specularly reflected by toner application surface 12. Based on the received radiation, the one or more photosensitive detectors included in specular reflection sensor 16 generate one or more output signals related to the one or more properties of the received radiation. For example, the one or more output signals may be related to an amount of the radiation, an intensity of the radiation, and/or other properties of the radiation. In one embodiment, the one or more photosensitive detectors include a single photosensitive diode, such as a PIN diode or other photosensitive diode. In other embodiments, other photosensitive devices are included in specular reflection detector 16. For instance, the photosensitive detectors may include a diode array, a CCD chip, a CMOS chip, and/or other photosensitive devices.

As the amount of toner mass present on toner application surface 12 varies, the manner in which electromagnetic radiation that is emitted by emitter 14 and is reflected by toner application surface 12 also varies. More particularly, an amount of electromagnetic radiation emitted from emitter 14 that is specularly reflected by toner application surface 12 and an amount of electromagnetic radiation emitted from emitter 14 that is diffusely reflected by toner application surface 12 vary as a function of an amount of toner mass present on toner application surface 12.

Referring to FIG. 2, the relationship between specular reflection, diffuse reflection, and toner mass on toner application surface 12 is illustrated as a plot. The general relationship between specularly reflected electromagnetic radiation is indicated as R on the plot, and diffusely reflected electromagnetic radiation is indicated as S on the plot. The line indicated as R+S represents a sum of the values of R and S as the amount of toner mass present on toner application surface 12 varies. As can be seen, the greater the amount of toner mass present on toner application surface 12, the lower the intensity of specularly reflected electromagnetic radiation R from the toner mass. On the other hand, as the amount of toner mass increases the reflectivity of the toner causing diffusely reflected electromagnetic radiation, S, increases. Note also that the diffuse light scattered from a bare substrate, having no toner thereon, is not zero.

Returning to FIG. 1, in one embodiment, toner application surface 12 is relatively smooth and reflective and, as was mentioned above, as more toner mass is carried by toner application surface 12 the reflection of electromagnetic radiation by toner application surface 12 becomes less specular. This is because less of the electromagnetic radiation is specularly reflected by the smooth toner application surface and instead is diffusely reflected by the irregular surface of the toner mass. Over the typical range of interest, the decrease in specular reflection of the electromagnetic radiation due to the increase in toner mass is roughly in proportion to the increase in the toner mass present on toner application surface 12. Over a range from substantially no toner mass to a target solid developed mass per unit area on toner application surface 12, the relationship between specular reflection and toner mass may be approximated by a second order polynomial.

In some implementations, the relationship between the amount of toner mass present on toner application surface 12 and the amount of electromagnetic radiation received by specular reflection sensor 16 may be described as follows:

$$I_{spec}=-a\cdot M_{toner}-b\cdot N_{loss}+c\cdot N_{surf}, \quad 1.$$

where $I_{spec}$ represents the intensity of the specularly reflected electromagnetic radiation; $M_{toner}$ represents the amount of toner mass per unit area present on toner application surface 12; $N_{loss}$ represents noise present in system 10 due to light loss (e.g., due to absorption, transmission, violations of the uniform diffuse scattering assumption, etc.); $N_{surf}$ represents noise present in system 10 due to irregularities in the mirror and/or diffuse properties of toner application surface 12; and a, b, and c represent proportionality coefficients that are greater than 0. As toner application surface 12 ages, it may be subjected to scratches from scratches with paper, cleaner brushes, cleaner blades, and/or other media. The loss of physical integrity due to these scratches may make toner application surface 12 less specular even when toner mass is not present. $N_{surf}$ may represent light loss caused by surface imperfections, such as scratches, on toner application surface 12. As has been mentioned above, $N_{loss}$ and $N_{surf}$ tend to increase with wear to toner application surface 12. Experimental data has shown that of the two sources of noise included in equation (1), $N_{loss}$ and $N_{surf}$, the noise caused by light loss ($N_{loss}$) is the dominant noise source.

Based on the relationship illustrated by equation (1), the relationship between the specular reflection output and the amount of toner mass present on toner application surface 12 can be represented as follows:

$$V_{spec}=-A\cdot M_{toner}-B\cdot N_{loss}+C\cdot N_{surf} \quad 2.$$

where $V_{spec}$ represents the specular reflection output; and A, B, and C represent proportionality coefficients. The proportionality coefficients A, B, and C may vary as a function of the intensity of emitter 14, the sensitivity of the one or more photosensitive detectors included in specular reflection sensor 16, the position of specular reflection sensor 16, the position of emitter 14, and/or other variables of system 10.

Diffuse reflection sensor 18 is arranged to receive electromagnetic radiation that has been emitted by emitter 14 and has been diffusely reflected by toner application surface 12. Diffuse reflection sensor 18 then generates a diffuse reflection output that represents one or more properties of the received electromagnetic radiation. In one embodiment, diffuse reflection sensor 18 includes one or more photosensitive detectors positioned to receive at least a portion of the electromagnetic radiation that is emitted by emitter 14 and diffusely reflected by toner application surface 12. Based on the received radiation, the one or more photosensitive detectors included in diffuse reflection sensor 18 generate one or more output signals related to the one or more properties of the received radiation. For example, the one or more output signals may be related to an amount of the radiation, an intensity of the radiation, and/or other properties of the radiation. As was the case with specular reflection sensor 16, in one embodiment, the one or more photosensitive detectors include a single photosensitive diode, such as a PIN diode or other photosensitive diode. In other embodiments, other photosensitive devices are included in diffuse reflection detector 18. For instance, the photosensitive detectors may include a diode array, a CCD chip, a CMOS chip, and/or other photosensitive devices.

As the amount of toner mass present on toner application surface 12 varies, the amount of electromagnetic radiation that is emitted by emitter 14 and diffusely reflected by toner application surface 12 also varies. As was discussed above, in the embodiment in which toner application surface 12 is relatively smooth and reflective, as more toner mass is carried by toner application surface 12 the reflection of the electromagnetic radiation becomes less specular and more diffuse. Again, this is because less of the electromagnetic radiation is specularly reflected by the smooth toner application surface and instead is diffusely reflected by the irregular surface of the toner mass. The increase in diffuse reflection of the electromagnetic radiation due to the increase in toner mass is roughly in proportion to the increase in the toner mass present on toner application surface 12.

In some implementations, the relationship between the amount of toner mass present on toner application surface 12 and the amount of electromagnetic radiation received by diffuse reflection sensor 18 may be described as follows:

$$I_{diff}=d\cdot M_{toner}-e\cdot N_{loss}-f\cdot N_{surf}; \quad 3.$$

where $I_{diff}$ represents the intensity of the diffusely reflected electromagnetic radiation; and d, e, and f represent proportionality coefficients that are greater than 0. As was the case with the intensity of specularly reflected electromagnetic radiation, in equation (3) $N_{loss}$ is the dominant noise source with respect to $N_{surf}$.

Based on the relationship illustrated by equation (3), the relationship between the diffuse reflection output and the amount of toner mass present on toner application surface 12 can be represented as follows:

$$V_{diff}=D\cdot M_{toner}-E\cdot N_{loss}-F\cdot N_{surf} \quad 4.$$

where $V_{diff}$ represents the diff reflection output; and D, E, and F represent proportionality coefficients. The proportionality coefficients A, B, and C may vary as a function of the intensity of emitter 14, the sensitivity of the one or more photosensitive detectors of specular reflection sensor 16, the position of specular reflection sensor 16, the position of emitter 14, and/or other variables of system 10.

It should be appreciated that the illustration of emitter 14, specular reflection sensor 16, and diffuse reflection sensor 18 are provided merely as an exemplary arrangement capable of providing information related to the specular and diffuse reflection of electromagnetic radiation from toner application surface 12. In other embodiments, alternative arrangements of emitters and/or sensors may be implemented. For instance, in one embodiment, a single sensor may be used in conjunction with a plurality of emitters. The emitters including emitters that are arranged to provide specularly reflected electromagnetic radiation to the single sensor and emitters that are arranged to provide diffusely reflected electromagnetic radiation to the single sensor. This embodiment may include the arrangement of emitters and/or sensor disclosed in U.S. Pat. No. 5,204,538, entitled "Densitometer for an Electrophotographic Printer Using Focused and Unfocused Reflecting Beams," and issued Apr. 20, 1993, the contents of which are hereby incorporated by reference into the present disclosure.

Processor 20 is operatively linked with sensors 16 and 18. This operative link may be embodied in any operative communications link. For example, processor 20 may be linked with sensors 16 via a wired link, a wireless link, a dedicated connection, a network connection, and/or other operative communications links. Processor 20 receives the specular reflection output from specular reflection sensor 16 and the diffuse reflection output from diffuse reflection sensor 18 and based on these outputs determines the amount of toner mass present on toner application surface 12. As is discussed further below, in some embodiments, processor 20 determines the amount of toner mass present on toner application surface 12 from the specular reflection output and the diffuse reflection output based on the relationships described by equations (2) and (4) above.

In the embodiments illustrated in FIG. 1, processor 20 includes a calibration module 22, a scaling module 24, an output combination module 26, and a mass determination module 28. Modules 22, 24, 26, and 28 may be implemented in software; hardware; firmware; some combination of software, hardware, and/or firmware; and/or otherwise implemented. It should be appreciated that although modules 22, 24, 26, and 28 are illustrated in FIG. 1 as being co-located within a single processing unit, processor 20 may include multiple processing units, and that some of these processing units may be located remotely from each other. In such embodiments, one or more of modules 22, 24, 26, and 28 may be located remotely from the other modules and operative communication between the modules may be achieved via one or more communication links. Such communication links may be wireless or hard wired. Further, it should be appreciated that the assignment of functionalities to modules 22, 24, 26, and 28 herein has been done for illustrative purposes. In practice, modules of system 10 may provide functionality attributed to more than one of modules 22, 24, 26, and 28. Similarly, in some implementations, the functionality of a single one of modules 22, 24, 26, and 28 may be performed by a plurality of modules included in system 10.

Calibration module 22 is configured to execute operations that calibrate system 10. For instance, as is discussed further below, in some embodiments calibration module 22 determines one or more scaling factors. The scaling factors may include one or more scaling factors that are applied to the specular reflection output and the diffuse reflection output separately and/or a scaling factor that is applied to a combined output that is a combination of the specular reflection output and the diffuse reflection output. Calibration module 22 determines the scaling factors to enhance the accuracy of system 10 in determining the amount of toner mass present on toner application surface 12. The scaling factors determined by calibration module 22 may be related to coefficients A, B, C, D, E, and F in equations (2) and (4) above.

In some instances $N_{loss}$ may vary over time. Therefore, in some embodiments, calibration module 22 may determine the scaling factors upon "start-up" of a reprographic system associated with toner application surface 12, at predetermined intervals during the use of a reprographic system associated with toner application surface 12, and/or at other predetermined times. The predetermined intervals during the use of the reprographic system associated with toner application surface 12 are determined to enable the reprographic system to operate within predetermined tolerances. In one embodiment, the predetermined intervals are dictated by the reprographic system and/or system 10. In one embodiment, a user is enabled to enter and/or adjust the predetermined intervals.

Scaling module 24 applies the scaling factors determined by calibration module 22 to outputs in system 10. For example, in some embodiments, scaling module 24 applies scaling factors individually to one or both of the specular reflection output and the diffuse reflection output. The application of scaling factors to outputs in system 10 is discussed further below.

Combination module 26 combines the specular reflection output and the diffuse reflection output to create a combined output. In some of the embodiments in which specular reflection sensor 16 and/or diffuse reflection sensor 18 include photosensitive detectors that generate output signals as the specular reflection output and the diffuse reflection output, combination module 26 may include a differential amplifier that combines the output signals. The differential amplifier of combination module 26 may be embodied in a physical electronic circuit, or in a virtual electronic circuit. For instance, in a virtual electronic circuit the output signals from sensors 16 and 18 may be converted to digital values and may be processed to combine the signals by digital processing, thereby producing a digital signal with substantially the same values as an analog differential amplifier circuit.

As was mentioned above in the discussion of equations (2) and (4), the dominant source of noise in system 10, $N_{loss}$, is caused by light lost in system 10, such as light lost to transmission and/or absorption at toner application surface 12, light rays that violate the uniform diffuse scattering assumption, and/or other light lost in system 10. From equations (2) and (4) it can be seen that the impact of this source of noise on the specular reflection output $V_{spec}$ has a positive correlation with respect to the impact of this source of noise on the diffuse reflection output $V_{diff}$. In light of this correlation, combination of the spectral reflection output with the diffuse reflection output by combination module may include subtracting one of the reflection outputs $V_{spec}$ or $V_{diff}$. This subtraction will create a combined output with a significantly reduced amount of noise present in comparison with the individual reflection outputs (provided the spectral reflection output and/or the diffuse reflection output are scaled properly).

Determination module 28 determines the amount of toner mass present on the toner application surface based on the combined output created by combination module 26. The determination of the amount of toner mass from the combined output is discussed further below.

In some instances, system 10 includes a storage module 30. Storage module 30 is operatively linked to processor 20 and operates to store information for access by processor 20. For example, some or all of modules 22, 24, 26, and/or 28 may store information to storage module 30 and/or access, manipulate, and/or interact with information stored on storage module 30. In one embodiment, storage module 30 includes an electronically readable medium such as a magnetic medium (e.g., a hard drive), an optical medium (e.g., an optical disc), a solid state medium (e.g., a flash drive), etc.

FIG. 3 illustrates one or more embodiments of a method 32 of determining an amount of toner mass present on a toner application surface. In some implementations, the operations of method 32 are executable by the components of system 10 as described hereafter. However, it should be appreciated that this is not intended to be limiting, as other systems capable of executing the operations of method 32 exist within the scope of this disclosure.

At an operation 34 electromagnetic radiation is directed to become incident on the toner application surface. In one embodiment, operation 34 is executed by the emission of electromagnetic radiation emitter 14 onto toner application surface 12, as shown in FIG. 1 and described above.

Referring back to FIG. 3, the electromagnetic radiation that is specularly reflected from the toner application surface is received at an operation 36. For instance, the electromagnetic radiation may be received by a sensor capable of detecting one or more properties of the electromagnetic radiation. In one embodiment, operation 36 is performed by specular reflection sensor 16 (FIG. 1), as was discussed previously.

A specular reflection output is generated at an operation 38. The specular reflection output is representative of one or more of the properties of the electromagnetic radiation received at operation 36. For example, the specular reflection output may be representative of an intensity, an amount, and/or other properties of the electromagnetic radiation received at operation 36. In one embodiment, operation 38 is performed by specular reflection sensor 16 (FIG. 1) in the manner set forth above.

At an operation 40, the electromagnetic radiation that is diffusely reflected from the toner application surface is received. For instance, the electromagnetic radiation may be received by a sensor capable of detecting one or more properties of the electromagnetic radiation. In one embodiment, operation 40 is performed by diffuse reflection sensor 18 (FIG. 1), as described above.

A diffuse reflection output is generated at an operation 42. The diffuse reflection output is representative of one or more of the properties of the electromagnetic radiation received at operation 40. For example, the diffuse reflection output may be representative of an intensity, an amount, and/or other properties of the electromagnetic radiation received at operation 40. In one embodiment, operation 42 is executed by diffuse reflection sensor 18 (FIG. 1) in the manner set forth previously.

At operations 44 and 46 the outputs generated by operations 38 and 42 are scaled and combined, respectively. As was mentioned above with respect to combination module 26 (FIG. 1), the combination of the specular reflection output and the diffuse reflection output can be executed to create a combined output with a reduced amount of noise in comparison with the individual specular reflection and diffuse reflection outputs. For instance, in one embodiment, the specular reflection output and the diffuse reflection output can be combined at operation 46 by differencing the outputs. At operation 44, one or both of the specular reflection output and/or the diffuse reflection output may be scaled so that when the reflection outputs are combined the noise present in the combined output is further suppressed.

By way of illustration, in one embodiment, differencing of the specular reflection and diffuse reflection outputs (as described by equations 2 and 4, respectively) generated by a system executing method 32 can be represented as:

$$V_{diff}-V_{spec}=D\cdot M_{toner}-E\cdot N_{loss}-F\cdot N_{surf}+A\cdot M_{toner}+B\cdot N_{loss}-C\cdot N_{surf}; \quad 5.$$

Since the dominant source of noise in the individual outputs is $N_{loss}$, for the purposes of this discussion the $N_{surf}$ terms may be removed from equation (5). Upon removal of the $N_{surf}$ terms, equation (5) simplifies to:

$$V_{diff}-V_{spec}=M_{toner}\cdot(A+D)+N_{loss}\cdot(B-E) \quad 6.$$

Thus, the combined signal includes a component that is proportional to the amount of toner mass present on the toner application surface ($M_{toner}\cdot(A+D)$), and a component that is proportional to the common signal noise represented by $N_{loss}$ ($N_{loss}\cdot(B-E)$). From equation (6) it should be apparent that by scaling one or both of the specular reflection output and/or the diffuse reflection output appropriately at operation 44, the (B−E) term in equation (6) can be reduced to substantially zero, effectively eliminating (or at least significantly reducing) the impact of noise in system 10 due to light loss on the combined signal created by operation 46.

For example, if the specular reflection output, $V_{spec}$, is scaled at operation 44 by a scaling factor that is substantially equal to E/B, then combination at operation 46 by differencing the specular reflection output and the diffuse reflection output would result in the following combined output (compare with equation (6)):

$$V_{diff}-\frac{E\cdot V_{spec}}{B}=M_{toner}\cdot\left(\frac{E\cdot A}{B}+D\right)+N_{loss}\cdot(E-E). \quad 7.$$

It should be appreciated from equation (7) that scaling the specular reflection output, $V_{spec}$, at operation 44 by a scaling factor that is substantially equal to E/B results in the term associated with noise present in system 10 due to light loss, $N_{loss}$, falling out of the combined output created by operation 46. In other words, the combined ouput expressed by equation (7) simplifies to:

$$V_{diff}-\frac{E\cdot V_{spec}}{B}=M_{toner}\cdot\left(\frac{E\cdot A}{B}+D\right). \quad 8.$$

While the above-illustrated example discusses scaling only one of the reflection outputs, the specular reflection output, at operation 44, this is not intended to be limiting. It should be appreciated that the same result (the cancellation of the noise present in the system due to light loss) may be effected by scaling just the other reflection output or scaling both of the reflection outputs at operation 44. It can further be seen from the foregoing that the scaling and combination of the reflection outputs to create a combined output that is substantially free from noise enables the toner application surface to be used without recalibrating a printing device in which the toner application surface is installed to account for degradation of the toner application surface. This is due to the cancellation of at least some of the effects of this degradation (e.g., noise due to light loss) achieved by appropriately scaling one or both of the reflection outputs at operation 44 and then combining the scaled outputs at operation 46. In one embodiment, operations 44 and 46 are performed by modules 24 and 26 of system 10 illustrated in FIG. 1 and discussed above.

Returning to FIG. 3, at an operation 48, the amount of toner mass present on the toner application surface is determined from the combined output created at operation 46. For instance, in one embodiment, operation 48 includes scaling the combined output by a predetermined scaling factor to determine the amount of toner mass. In other embodiments, other methods of determining toner mass from the combined output may be implemented. For example, in one embodiment operation 48 includes referring to a look-up table to determine the amount of toner mass present on the toner application surface. In one embodiment, operation 48 is executed by mass determination module 28.

Figure 4:
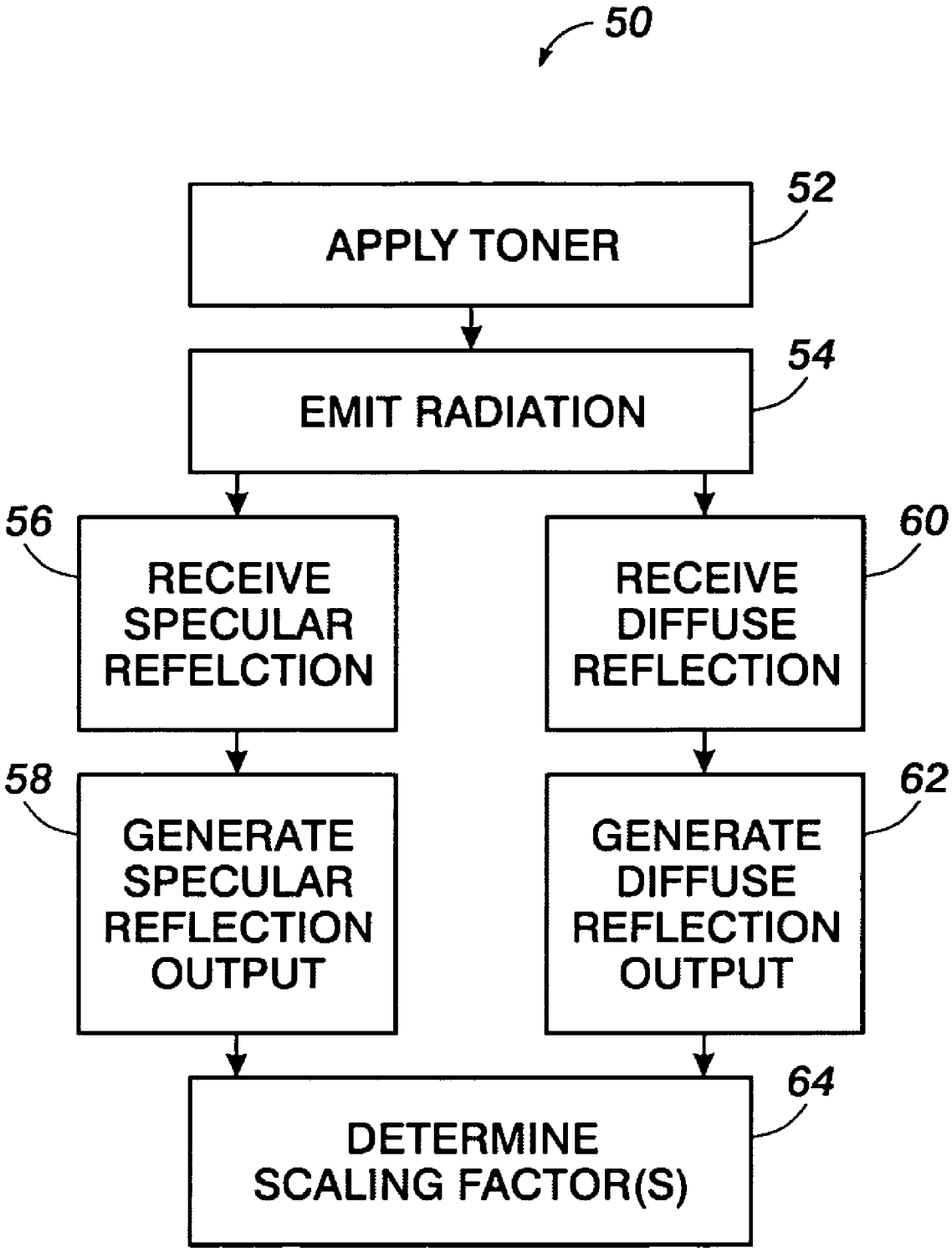
FIG. 4 illustrates a method of calibrating a system configured to determine an amount of toner mass present on a toner application surface.

FIG. 4 illustrates one or more embodiments of a method 50 of calibrating a system that determines an amount of toner mass present on a toner application surface. In one embodiment, method 50 includes determining one or more scaling factors that can be used to scale outputs generated by one or both of a specular reflection sensor and a diffuse reflection sensor such that when the output or outputs are first scaled, and then combined, the combined output created by the combination is substantially free from noise caused by at least one source of noise present in both reflection outputs. For example, in one implementation, the scaling factors determined according to method 50 are used in method 32 at operation 44 to scale one or both of the specular reflection output and the diffuse reflection output. In one embodiment, method 50 is used to calibrate the system for an extended period of time (e.g., for its lifetime). Accordingly, method 50 may be used to calibrate the system at its manufacture. In some implementations, the operations of method 50 are executable by the components of system 10 as described hereafter. However, it should be appreciated that this is not intended to be limiting, as other systems capable of executing the operations of method 50 exist within the scope of this disclosure.

At an operation 52, a known amount of toner is applied to the toner application surface. For example, the known amount of toner can be substantially zero. In one embodiment, operation 52 is executed by applying the known amount of toner to toner application surface 12 (FIG. 1) discussed above.

At an operation 54 electromagnetic radiation is directed to become incident on the toner application surface. In one implementation, operation 54 is executed by the emission of electromagnetic radiation emitter 14 onto toner application surface 12, as shown in FIG. 1 and described above.

Referring back to FIG. 4, the electromagnetic radiation that is specularly reflected from the toner application surface is received at an operation 56. For instance, the electromagnetic radiation may be received by a sensor capable of detecting one or more properties of the electromagnetic radiation. In one embodiment, operation 56 is performed by specular reflection sensor 16 (FIG. 1), as was discussed previously.

A specular reflection output is generated at an operation 58. The specular reflection output represents one or more of the properties of the electromagnetic radiation received at operation 56. For example, the specular reflection output may represent an intensity, an amount, and/or other properties of the electromagnetic radiation received during operation 56 from the toner application surface. In one embodiment, operation 58 is performed by specular reflection sensor 16 (FIG. 1) in the manner set forth above.

At an operation 60, the electromagnetic radiation that is diffusely reflected from the toner application surface is received. For instance, the electromagnetic radiation may be received by a sensor capable of detecting one or more properties of the electromagnetic radiation. In one embodiment, operation 60 is performed by diffuse reflection sensor 18 (FIG. 1), as described above.

A diffuse reflection output is generated at an operation 62. The diffuse reflection output is representative of one or more of the properties of the electromagnetic radiation received at operation 60. For example, the diffuse reflection output may be representative of an intensity, an amount, and/or other properties of the electromagnetic radiation received during operation 60 from the toner application surface. In one embodiment, operation 62 is executed by diffuse reflection sensor 18 (FIG. 1) in the manner set forth previously.

At an operation 64 at least one scaling factor is determined based on the specular reflection output generated by operation 58 and the diffuse reflection output generated by operation 62. In the implementation in which the known amount of toner mass present on the toner application surface is zero, and using the form of equation (2), the specular reflection output may be expressed in a simplified form (e.g., dropping the $N_{surf}$ term for the reasons discussed above) as:

$$V_{spec}=-B\cdot N_{loss}. \quad 9.$$

The diffuse reflection output may be expressed, using the form of equation (4) in a similarly simplified form as:

$$V_{diff}=-E\cdot N_{loss}. \quad 10.$$

In some embodiments, operation 64 includes dividing one of the reflection outputs by the other reflection output to determine an appropriate scaling factor. For example, the division of the diffuse reflection output expressed in equation 10 by the specular reflection output expressed in equation 9 would simplify to E/B. As is discussed above with respect to method 32, E/B is a scaling factor that can be used to scale the specular reflection output so that when the specular reflection output and the diffuse reflection output are combined to create a combined output, the combined output is substantially free from noise caused by light loss in the system being calibrated.

It should be appreciated that although in the example in which the known toner mass amount is zero the determination of at least one scaling factor is somewhat simplified, in other embodiments other known amounts of toner may be used. For instance, two or more different amounts of toner may be used and then the sets of reflection outputs can be divided and solved for the at least one scaling factor as simultaneous equations.

In some implementations, the determination of the at least one scaling factor at operation 64 is based on specular reflection outputs and diffuse reflection outputs that correspond to readings taken by the specular reflection outputs and the diffuse reflection outputs at a plurality of locations on the toner application surface. As should be apparent, this may enhance the overall accuracy of the determined scaling factors by incorporating the reflection signature of the toner application surface for a relatively large portion of the toner application surface (e.g., substantially all of the toner application surface) into the calibration, rather than just a single point on the surface. For example, in one embodiment in which the toner application surface is provided by a belt, the toner application surface is actuated such that the plurality of locations become sequentially located within the electromagnetic radiation being directed towards the toner application surface. For instance, the electromagnetic radiation may be directed to a fixed point in space, and the belt that provides the toner application surface is driven by rollers past the fixed point.

In embodiments in which readings are taken by the specular reflection sensor and the diffuse reflection sensor at a plurality of locations on the toner application surface, a variety of algorithms may be implemented to determine the at least one scaling factor from the plurality of readings. For example, in one embodiment at least one scaling factor is determined (e.g., via the method described above) for each of the plurality of locations on the toner application surface, and then the plurality of scaling factors are averaged, or otherwise aggregated, to determine a aggregated scaling factor to be used by the system. In another embodiment, the outputs from the plurality of readings by the specular reflection sensor are averaged, or otherwise aggregated, to determine an aggregated specular reflection output. Similarly, the outputs from the plurality of readings by the diffuse reflection sensor are averaged, or otherwise aggregated, to determine an aggregated diffuse reflection output. Then the aggregated specular reflection output and the aggregated diffuse reflection output are used to determine the at least one scaling factor (e.g., by division as described above).

In one embodiment, operation 64 is performed by calibration module 22 (FIG. 1) discussed above. Calibration module 22 (or some other module executing operation 64) may further store the determined at least one scaling factor for later use by the system in determining the toner mass amount. For instance, calibration module 22 may store the at least one scaling factor to storage module 30, as shown in FIG. 1 and discussed previously.

Figure 5:
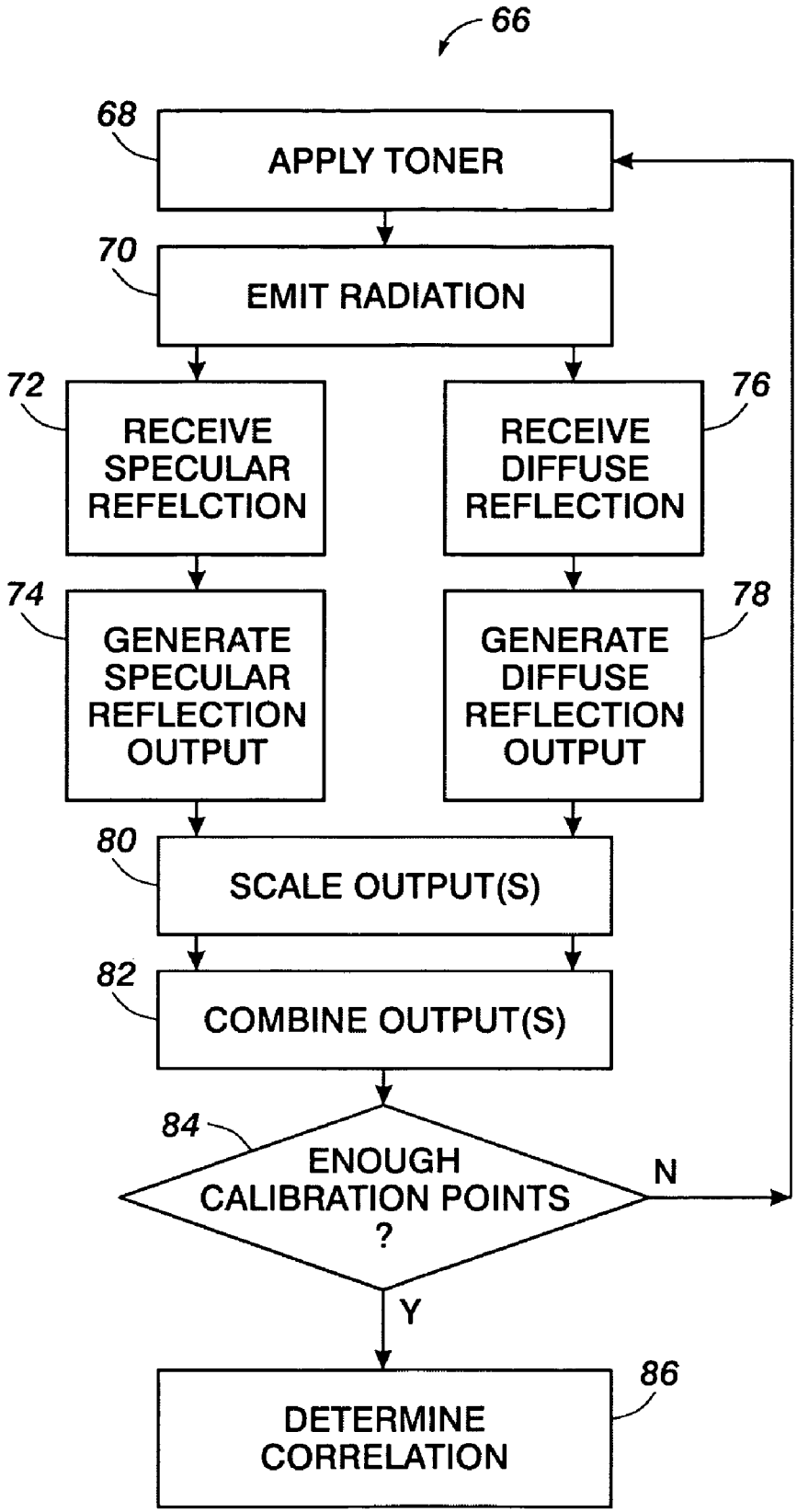
FIG. 5 illustrates a method of calibrating a system configured to determine an amount of toner mass present on a toner application surface.

FIG. 5 illustrates one or more embodiments of a method 66 of calibrating a system that determines an amount of toner mass present on a toner application surface. In one embodiment, method 66 is used to calibrate the system for an extended period of time (e.g., for its lifetime). Accordingly, method 66 may be used to calibrate the system at its manufacture. In some implementations, the operations of method 66 are executable by the components of system 10 (FIG. 1) as described hereafter. However, it should be appreciated that this is not intended to be limiting, as other systems capable of executing the operations of method 66 exist within the scope of this disclosure.

At an operation 68, a known amount of toner is applied to the toner application surface. In one embodiment, operation 68 is executed by applying the known amount of toner to toner application surface 12 (FIG. 1) discussed above.

At an operation 70 electromagnetic radiation is directed to become incident on the toner application surface. In one implementation, operation 70 is executed by the emission of electromagnetic radiation emitter 14 onto toner application surface 12, as shown in FIG. 1 and described above.

Referring back to FIG. 5, the electromagnetic radiation that is specularly reflected from the toner application surface is received at an operation 72. For instance, the electromagnetic radiation may be received by a sensor capable of detecting one or more properties of the electromagnetic radiation. In one embodiment, operation 72 is performed by specular reflection sensor 16 (FIG. 1), as was discussed previously.

A specular reflection output is generated at an operation 74. The specular reflection output represents one or more of the properties of the electromagnetic radiation received at operation 72. For example, the specular reflection output may represent an intensity, an amount, and/or other properties of the electromagnetic radiation received during operation 72 from the toner application surface. In one embodiment, operation 74 is performed by specular reflection sensor 16 (FIG. 1) in the manner set forth above.

At an operation 76, the electromagnetic radiation that is diffusely reflected from the toner application surface is received. For instance, the electromagnetic radiation may be received by a sensor capable of detecting one or more properties of the electromagnetic radiation. In one embodiment, operation 76 is performed by diffuse reflection sensor 18 (FIG. 1), as described above.

A diffuse reflection output is generated at an operation 78. The diffuse reflection output is representative of one or more of the properties of the electromagnetic radiation received at operation 76. For example, the diffuse reflection output may be representative of an intensity, an amount, and/or other properties of the electromagnetic radiation received during operation 76 from the toner application surface. In one embodiment, operation 78 is executed by diffuse reflection sensor 18 (FIG. 1) in the manner set forth previously.

At operations 80 and 82 the outputs generated by operations 74 and 78 are scaled and combined, respectively. As has been discussed above, the combination of the specular reflection output and the diffuse reflection output can be executed to create a combined output with a reduced amount of noise in comparison with the individual specular reflection and diffuse reflection outputs. For instance, in one embodiment, the specular reflection output and the diffuse reflection output can be combined at operation 82 by differencing the outputs. At operation 80, one or both of the specular reflection output and/or the diffuse reflection output may be scaled (e.g., using the at least one scaling factor determined by method 50) so that when the reflection outputs are combined at operation 82 the noise present in the combined output is further suppressed. In one embodiment, operations 44 and 46 are performed by modules 24 and 26, respectively, of system 10 (FIG. 1) as discussed above.

The combined output created at operation 82 becomes a calibration point that can be used to determine the amount of toner mass on the toner application surface. At an operation 84 a decision is made as to whether enough calibration points have been determined to enable a determination between the amount of toner mass on the toner application surface and the combination of the outputs of the spectral reflection sensor and the diffuse reflection sensor. In some implementations, the number of calibration points required may be two or more. In one embodiment, operation 84 is executed by calibration module 22 (FIG. 1) described previously.

If it is determined at operation 84 that more calibration points are needed, then method 66 proceeds back to operation 68 and a (different) known amount of toner is applied to the toner application surface so that another calibration point can be determined. If it is determined at operation 84 that no more calibration points are needed, then method proceeds to an operation 86.

At operation 86 the calibration points (e.g., the combined outputs for two or more different known toner mass amounts) are used to determine the correlation between (i) the combined outputs of the spectral reflection sensor and the diffuse reflection sensor, and (ii) the amount of toner mass present on the toner application surface. For example, in one embodiment a curve-fitting algorithm is used to determine a curve that fits to the calibration points and describes the amount of toner mass present as a function of the combined output of the reflection sensors. For instance, the curve may take the following form (derived from equations (2) and (4)):

$$M_{toner} = \frac{1}{\left(\frac{E \cdot A}{B} + D\right)} \cdot V_{combined}; \qquad 11.$$

where $V_{combined}$ is the combined output (specified in equation (8) as $$V_{diff} - \frac{E \cdot V_{spec}}{B},$$

where E/B is the scaling factor). In another embodiment, the calibration points are used to generate a look-up table that returns an amount of toner mass present in response to the combined output of the reflection sensors.

It should be appreciated that although the subject matter of the disclosure has been set forth with respect to the environment of a printing device, this has been done for illustrative purposes and is not intended to be limiting. For example, other systems that include implement a spectral reflection sensor that (i) is co-located with a diffuse reflection sensor and (ii) experiences a common source of noise with the diffuse reflection sensor are contemplated by this disclosure. In such systems, the output of the spectral reflection sensor and the output of the diffuse reflection sensor may be scaled and combined in the manner described above to achieve substantially the same results.

Thus, the subject matter of this application has been described in conjunction with the specific embodiments outlined above, it is evident that many alternatives, modifications and variations will be apparent to those skilled in the art. Accordingly, the preferred embodiments as set forth above are intended to be illustrative, not limiting. Various changes may be made without departing from the spirit and scope of the following claims.

What is claimed is:

1. A system that determines an amount of marking material present on a application surface, the system comprising:

a specular reflection sensor that (i) is arranged to receive primarily electromagnetic radiation that has been specularly reflected by the application surface and (ii) is configured to generate a specular reflection output representative of one or more of the properties of the electromagnetic radiation received by the specular reflection sensor;

a diffuse reflection sensor that (i) is arranged to receive primarily electromagnetic radiation that has been diffusely reflected by the application surface and (ii) is configured to generate a diffuse reflection output representative of one or more of the properties of the electromagnetic radiation received by the diffuse reflection sensor; and a processor that (i) creates a combined output by differencing the specular reflection output and the diffuse reflection output, and (ii) determines an amount of marking material present on the application surface based on the combined output.

2. The system of claim 1, wherein the processor further scales at least one of the specular reflection output or the diffuse reflection output by a predetermined scaling factor, wherein the processor scales the at least one of the specular reflection output or the diffuse reflection output before differencing the outputs.

3. The system of claim 2, wherein the processer is configured to scale each of the specular reflection output and the diffuse reflection output by separately determined predetermined scaling factors.

4. The system of claim 1, wherein (i) the specular reflection output comprises an output signal generated by the specular reflection sensor, (ii) the diffuse reflection output comprises an output signal generated by the diffuse reflection sensor, and (iii) the processor comprises a differential amplifier that differences the output signals.

5. The system of claim 1, wherein the predetermined scaling factor or factors are determined to compensate for irregularities in one or more surface properties of the application surface.

6. The system of claim 1, wherein the application surface is provided on either a belt or a drum of a printing device.

7. The system of claim 1, further comprising a storage module, and wherein the predetermined scaling factor or factors are stored to the storage module during manufacture of the system.

8. A method of determining an amount of marking material present on a application surface, the method comprising:

separately receiving electromagnetic radiation that has been specularly reflected by the application surface;

generating a specular reflection output representative of one or more of the properties of the received electromagnetic radiation that has been specularly reflected by the application surface;

separately receiving electromagnetic radiation that has been diffusely reflected by the application surface;

generating a diffuse reflection output representative of one or more of the properties of the received electromagnetic radiation that has been diffusely reflected by the application surface;

differencing the specular reflection output and the diffuse reflection output to create a combined output; and determining an amount of marking material present on the application surface based on the combined output.

9. The method of claim 8, further comprising scaling at least one of the specular reflection output or the diffuse reflection output by a predetermined scaling factor, wherein scaling at least one of the specular reflection output or the diffuse reflection output takes place prior to combining the specular reflection output and the diffuse reflection output.

10. The method of claim 9, wherein scaling at least one of the specular reflection output or the diffuse reflection output by a predetermined scaling factor comprises scaling each of the specular reflection output and the diffuse reflection output by separately determined predetermined scaling factors.

11. The method of claim 8, wherein (i) generating the specular reflection output comprises generating an output signal, (ii) generating the diffuse reflection output comprises generating an output signal, and (iii) combining the specular reflection output and the diffuse reflection output comprises differencing the output signals using a differential amplifier.

12. The method of claim 8, wherein the predetermined scaling factor or factors are determined to compensate for irregularities in one or more surface properties of the application surface.

13. The method of claim 8, wherein the application surface is provided on either a belt or a drum of a printing device.

14. A method of calibrating a system configured to determine an amount of marking material present on a application surface, the method comprising:

a) directing electromagnetic radiation to the application surface while the application surface carries a known amount of marking material such that a portion of the electromagnetic radiation is specularly reflected by the application surface and a portion of the electromagnetic radiation is diffusely reflected by the application surface;

wherein one or more properties of the portion of electromagnetic radiation that is specularly reflected by the application surface and the portion of electromagnetic radiation that is diffusely reflected by the application surface vary as a function of (i) the amount of toner present on the application surface and (ii) noise caused by light loss in the system being calibrated;

b) receiving, with a specular reflection sensor, primarily electromagnetic radiation that has been specularly reflected from the application surface;

c) generating, with the specular reflection sensor, a specular reflection output that represents one or more of the properties of the electromagnetic radiation that has been specularly reflected from the application surface;

d) receiving, with a diffuse reflection sensor, primarily electromagnetic radiation that has been diffusely reflected from the application surface;

e) generating, with the diffuse reflection sensor, a diffuse reflection output that represents one or more of the properties of the electromagnetic radiation that has been diffusely reflected from the application surface; and f) determining, based on the specular reflection output and the diffuse reflection output, at least one scaling factor that can be used to scale outputs generated by one or both of the specular reflection sensor and the diffuse reflection sensor such that when outputs generated by the specular reflection sensor and the diffuse reflection sensor are scaled and then differenced to create a combined output, the combined output is substantially free from the noise caused by light loss in the system being calibrated.

15. The method of claim 14, wherein the known amount of toner is 0.

16. The method of claim 14, wherein steps (a)-(e) are performed at a plurality of locations on the application surface, and wherein step (f) comprises:

determining, for each of the plurality of locations on the application surface, at least one scaling factor for one or both of the outputs generated by the specular reflection sensor and the diffuse reflection sensor; and aggregating the scaling factors determined for each of the plurality of locations on the application surface.

17. The method of claim 14, wherein the application surface is provided on a belt of a printing device.

18. The method of claim 17, wherein the specular reflection sensor and the diffuse reflection sensor are provided on the printing device.

19. The method of claim 14, wherein steps (a)-(e) are performed at a plurality of locations on the application surface, and wherein step (f) comprises:

aggregating the specular reflection outputs generated for the plurality of locations on the application surface to determine an aggregated specular reflection output;

aggregating the diffuse reflection outputs generated for the plurality of locations on the application surface to determine an aggregated diffuse reflection output; and determining at least one scaling factor based on the aggregated specular reflection output and the aggregated diffuse reflection output.

20. The method of claim 14, further comprising repeating steps (a)-(f) at predetermined intervals.

* * * * *